US005487293A

United States Patent [19]

Lovejoy

[11] Patent Number: 5,487,293

[45] Date of Patent: Jan. 30, 1996

[54] HIGH INTENSITY PEENING FLAPS WITH FASTENER, AND WHEELS INCORPORATING SAME

[75] Inventor: Michael W. Lovejoy, Maplewood, Minn.

[73] Assignee: Minnesota Mining and Manufacturing Company, Saint Paul, Minn.

[21] Appl. No.: 324,746

[22] Filed: Oct. 18, 1994

[51] Int. Cl.[6] ..... B21J 5/00

[52] U.S. Cl. ..... 72/53; 451/465

[58] Field of Search ..... 72/53; 451/465, 451/466, 469, 464

[56] References Cited

U.S. PATENT DOCUMENTS

| | | | |
|---|---|---|---|
| 3,834,200 | 9/1974 | Winter | 72/53 |
| 5,013,811 | 5/1991 | Ross | 528/60 |
| 5,179,852 | 1/1993 | Lovejoy et al. | 72/53 |
| 5,203,189 | 4/1993 | Lovejoy et al. | 72/53 |
| 5,284,039 | 2/1994 | Torgerson | 72/53 |
| 5,298,303 | 3/1994 | Kerr et al. | 428/35.7 |

OTHER PUBLICATIONS

3M "Heavy Duty Roto Peen" (brochure no. 61–5000–9502–3) 3M Abrasive Systems Division, St. Paul, Minnesota, 1993; 4 pages.

3M "Heavy Duty Roto Peen Flap Wheel" Operating and Assembly Instructions (brochure no. 34–7017–9636–8) 3M Abrasive Systems Division, St. Paul, Minnesota, December 1988; 2 pages.

*Primary Examiner*—David Jones

*Attorney, Agent, or Firm*—Gary L. Griswold; Walter N. Kirn; James J. Trussell

[57] ABSTRACT

A fastener for use with a rotary peening flap to secure at least two overlapping strap portions together. The fastener includes a shaft for extending through apertures in the overlapping strap portions, a head adjoining one end of the shaft, and an elastic washer at the other end of the shaft. The head of the fastener forms an included edge angle of greater than approximately 90° at the intersection of the bottom and side surfaces of the head. The fastener maintains the overlapping portions of the strap under compression to prevent peening debris form becoming lodged between the fastener and the strap and between the overlapping portions of the strap and to prevent slippage between the strap and the fastener and between the strap portions. The elastic washer has sufficient elasticity to maintain compression as the strap portions become substantially thinner over prolonged use. A peening flap incorporating the fastener is also disclosed, as is a hub assembly incorporating the peening flap and fastener.

42 Claims, 6 Drawing Sheets

HIGH INTENSITY PEENING FLAPS WITH FASTENER, AND WHEELS INCORPORATING SAME

TECHNICAL FIELD

The invention relates to a peening flap of the type used with a rotatable hub having a plurality of like peening flaps to abrade a surface. Specifically, the invention relates to a fastener for securing together portions of the peening flap.

BACKGROUND OF THE INVENTION

Rotary peening apparatuses of the type illustrated in FIG. 1 have broad application in the abrasives field, for such things as cleaning, descaling, or otherwise abrading concrete, metal or other surfaces. This can be done to put a desired finish or texture on the surface, or to prepare the surface for a subsequent operation such as welding, painting or coating. As used herein, "high-intensity peening" is meant to include peening operations such as stress-relieving of metals, surface conditioning operations such as cleaning and descaling (i.e. removal of oxide scales and/or paint) of metals, creation of anti-slip surfaces, and surface conditioning of concrete. The peening apparatus includes a cylindrical hub having a plurality of flap slots, each of which retains one end of a peening flap. Each of the peening flaps includes one or more peening particle support bases positioned for contact with a workpiece surface when the hub is rotated about its central axis. The peening particle support bases each include on their exposed faces a plurality of hardened peening particles. These faces successively contact the workpiece surface during rotation of the hub, thereby abrading the workpiece surface.

One type of known peening flap and fastener is shown in FIGS. 2–6A. The peening flap 10 includes a strap 16, to which is fastened a plurality of peening particle support bases 24 each having peening particles 26 provided on the exposed face of each support base. Shank 25 extends to the interior of flap 10, and washer 23 is placed over the end of the shank 25 before the shank is flared to secure it to the flap. It is known to use a polymeric washer 23 to help withstand the impact of peening and to minimize cracking of the washer that was occurring with metal washers 23. Such peening flaps are available from Minnesota Mining and Manufacturing Company, of St. Paul, MN., and are known commercially as Heavy Duty Roto Peen flaps, Type B, Type C, and Type D. Peening flap 10 has a peening end 14 and a hub end 12. Strap 16 includes a first end 18, second end 22, and a medial portion 20 where a fastener 50 secures together overlapping portions of the ends to the medial portion. As seen in FIG. 5, flap 10 can optionally include wear pad 40 and support strap fin 39. This general construction of the peening flap 10 is further described in several sources, including U.S. Pat. No. 5,203,189. The construction of the peening particle support bases described above is further described in U.S. Pat. No. 5,179,852. The contents of both of these patents are incorporated herein by reference.

Known fastener 50 is shown in greater detail in FIG. 6, and includes rivet body 51 and metal washer 64. Rivet 51 includes a head 52 atop fastener shaft 60. Head 52 includes convex head top surface 66 and planar head bottom surface 68 which meet at joining edge 70. Shaft 60 adjoins head bottom surface 68 centrally thereof, and passes through aligned apertures 28 formed in each respective portion of strap 16. Peening flap 10 and strap 16 may have many different configurations, and could, for example, include more or less overlying segments of strap 16 than the three that are shown in FIG. 3 or the four that are shown in FIG. 5. The distal end of the shaft 60 projects from flap 10 sufficiently to enable a cooperative fastener member 64 to be secured by flaring fold down stem 62 to form rollover flare 62'. Known peening flap fasteners employ a steel back up washer as cooperative fastener member 64.

The peening flap having known fastener 50, although having its own utility, can display certain disadvantages. Among them is a phenomenon referred to as "premature failure" of the peening flaps, which is defined as imminent or actual separation of the strap portions from the fastener before the useful life of the peening support base and particles is exhausted.

It is desirable to impart a sufficient amount of compression to the fastened portions of strap 16 when assembling flap 10 with fastener 50. This reduces the slippage of the fastened portions of the strap relative to one another and relative to fastener 50 during use of peening flap 10. Such slippage can lead to increased heat and stress, reducing the life of the strap 16. Compression by the fastener 50 also helps keep abraded particles from becoming lodged between the strap 16 and the fastener 50, and between the fastened portions of the strap. Such debris can also reduce the useful life of strap 16. However, too much compression can cause edge 70 of the fastener head to tear into or otherwise damage strap 16.

In an attempt to minimize damage to the fabric of strap 16 by known fastener 50, while at the same time providing a desired amount of compression to the portions of the strap 16 fastened by fastener 50, assembly typically is as follows. Fastener shaft 60 is passed through apertures 28 in the strap 16, steel washer 64 is then placed over the end of shaft 60, and the fold down stems 62 of the fastener rivet 51 is mechanically deformed or flared to maintain the washer 64 on the shaft and to set a predetermined distance between head 52 and washer 64. This distance is determined empirically as described in greater detail below, and imparts the desired amount of compression to the fastened portions of strap 16.

Intense mechanical action occurs during high intensity peening. This includes centrifugal loads on the peening flap 10 as it is rotated at high speed about the hub, the impact loads caused by the peening particle supports bases 24 impacting the surface to be abraded, and bending of the strap 16 caused by the peening impact. These mechanical actions cause frictional heat and stress in the strap portions in the area of the fastener 50, which is increased by the heat and stress caused by the slippage of the fastened portions of the strap relative to one another and relative to the fastener 50. Additionally, head 52 and metal washer 64 tend to dig into and otherwise damage strap 16. All of this tends to cause the fastened strap portions to become thinner, thereby reducing or eliminating the amount of compression initially imparted by fastener 50 when assembling peening flap 10.

Because there is insufficient elastic deformation in known fastener 50, especially in metal washer 64, the initial compressive load is quickly lost as the fastened portions of strap 16 become thinner from wear, stretching, compression, or other causes. This increases the slippage of the fastened strap portions relative to one another and relative to fastener 50, thereby further increasing the heat and stress during operation and increasing the likelihood of premature strap failure. Loss of compression also allows severely abrasive abraded debris to become lodged between the fastener and the strap and between the overlapped portions of the strap.

This, too intensifies the heat and stress during high intensity peening and increases the likelihood of premature failure. Lodged debris becomes more of a problem as rotary peening devices are more frequently used to clean or scarify more brittle surfaces such as concrete. The sharp intersection 70 of rivet head top surface 66 and bottom surface 68 also contributes to premature failure. Furthermore, recent improvements in the materials and methods used to fabricate strap 16 and peening particle supports 24, and improved designs for peening flap 10, have extended the useful life of these components. See for example, U.S. Pat. Nos. 5,179,852, 5,203,189, and 5,298,303. As a result, the premature failure caused by fastener 50 has become the life limiting factor in using peening flaps 10.

A peening flap 10 exhibiting premature failure is shown in FIG. 7, wherein strap 16 has begun to tear away from fastener heads 52 at the hub side 29 of apertures 28. Peening particle support bases 24 and particles 26, although partially worn, still have useful life and are suitable for abrading a surface. Because a portion of strap 16 could completely detach from fasteners 50 with further use of the peening flap, a peening flap in such a condition is typically discarded even though the peening particles 26 and support bases 24 have not yet exhausted their useful lives. Therefore, this system results in unnecessary waste and increased costs, as the entire peening flap 10 must be replaced prior to exhausting the useful life of all of the components.

In view of the disadvantages of conventional peening flaps and fasteners, an unmet need exists for a durable fastener for a peening flap that will secure the end portions of the strap to the medial portion and that will withstand harsh operating conditions for a sufficient time that the full useful life of the peening heads can be enjoyed.

SUMMARY OF THE INVENTION

In accordance with the present invention, an improved fastener for securing the strap end portions to the strap medial portion is provided which affords increased flap life over previous constructions.

One aspect of the present invention presents a fastener for use in a peening flap of the type comprising a strap with a peening means affixed thereto and including at least first and second strap portions fastened together, said fastener comprising a shaft including a first end and a second end, a first head adjacent said first end, and a second head adjacent said second end, wherein said first and second strap portions have a combined thickness and are secured between said first and second heads, wherein said second head includes elastic compression means for maintaining compression on said strap portions, said elastic compression means having sufficient elasticity to maintain compression on said strap portions with reducing combined thickness.

Another aspect of the invention presents a peening flap comprising a strap including a first strap portion, a second strap portion, a first aperture formed in said first portion and a second aperture formed in said second portion, peening means mounted on said strap, and a fastener affixed to said strap for securing said first and second strap portions together, said fastener including a shaft extending through said apertures, said shaft having a first end and a second end, and a first head adjoining said first end and a second head adjoining said second end, wherein said first and second strap portions have a combined thickness and are secured between said first and second heads, wherein said second head includes elastic compression means for maintaining compression on said strap portions, said elastic compression means having sufficient elasticity to maintain compression on said strap portions with reducing combined thickness.

A further aspect of the invention presents a rotary peening wheel comprising a hub and at least one peening flap fastened to said hub, wherein said peening flap includes a strap including a first strap portion, a second strap portion, a first aperture formed in said first portion and a second aperture formed in said second portion, peening means mounted on said strap; and a fastener for securing said first and second strap portions together under compression, said fastener including a shaft extending through said apertures, said shaft including a first end and a second end; and a first head adjoining said first end and a second head adjoining said second end; wherein said first and second strap portions have a combined thickness and are secured between said first and second heads; and wherein said second head includes elastic compression means for maintaining compression on said strap portions, said elastic compression means having sufficient elasticity to maintain compression on said strap portions with reducing combined thickness.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
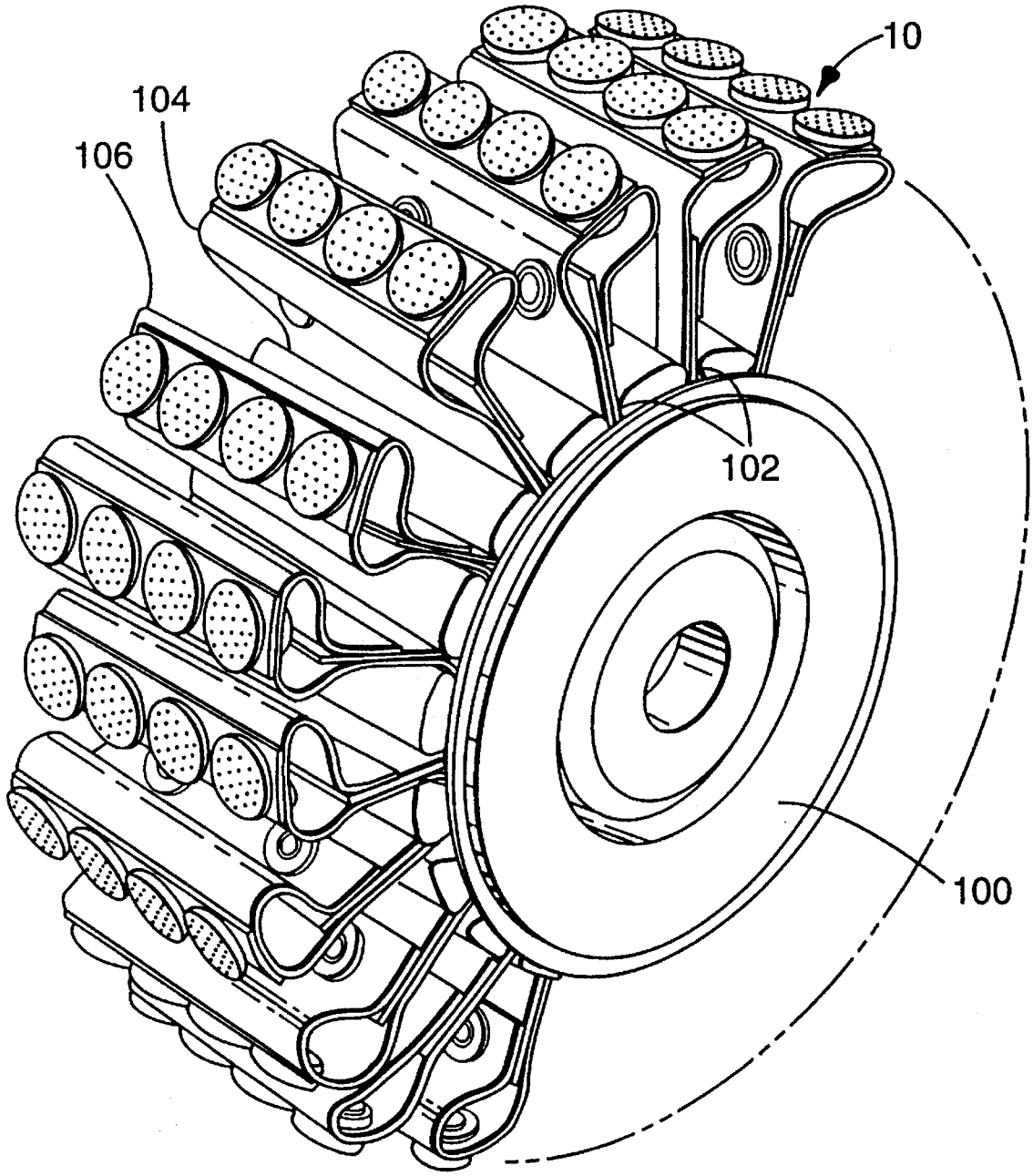
FIG. 1 is a perspective view of a rotary peening apparatus including a plurality of peening flaps constructed in accordance with the present invention.
Figure 2:
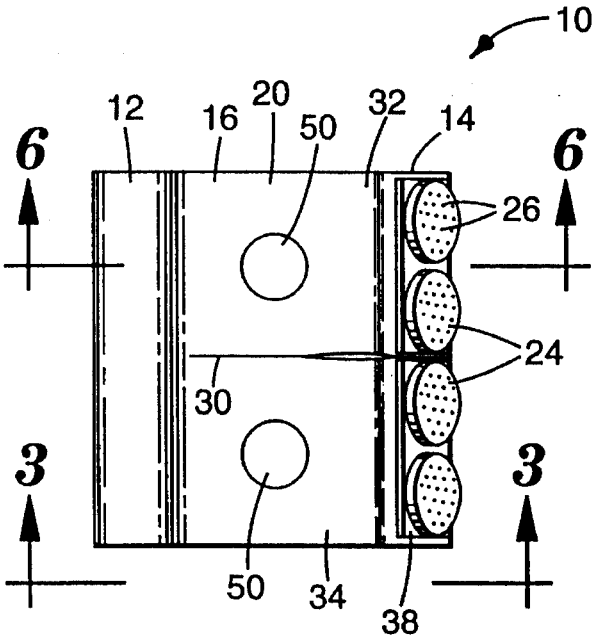
Fig. 2 PRIOR ART
FIG. 2 is a top plan view of one embodiment of a known peening flap and fastener.
Figure 3:
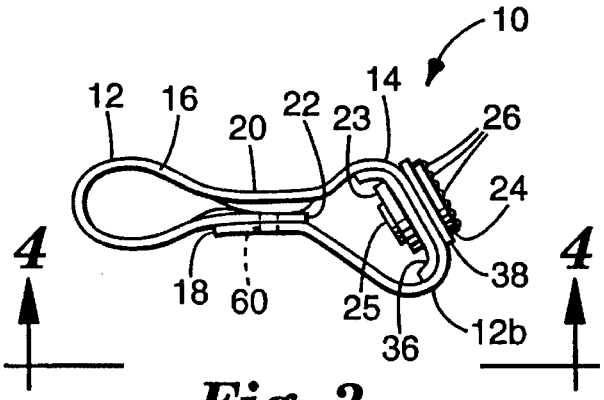
Fig. 3 PRIOR ART
FIG. 3 is a side view of the peening flap of FIG. 2 taken along line 3—3.
Figure 4:
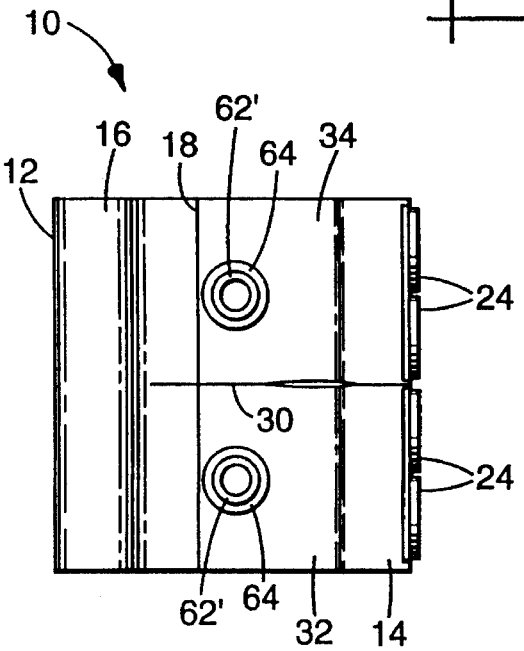
Fig. 4 PRIOR ART
FIG. 4 is a bottom plan view of the peening flap of FIG. 3 taken along line 4—4.
Figure 5:
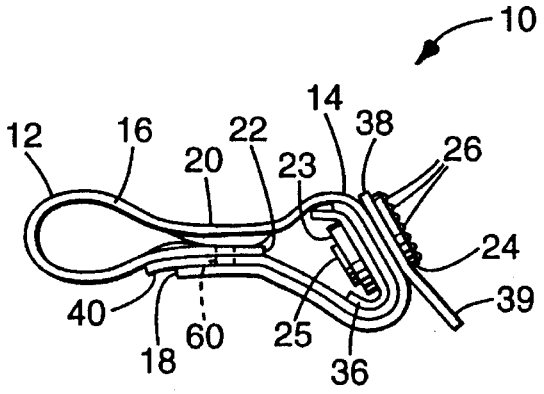
Fig. 5 PRIOR ART
FIG. 5 is a view like FIG. 3 of an alternate embodiment of the peening flap.
Figure 6:
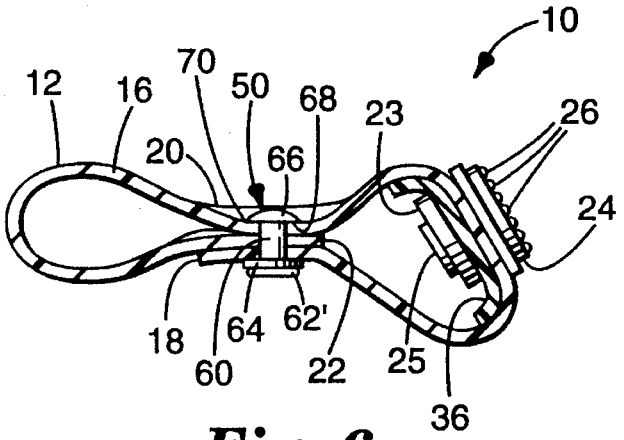
Fig. 6 PRIOR ART
FIG. 6 is cross-sectional view taken along line 6—6 of the peening flap of FIG. 2, showing the known fastener.
Figure 6A:
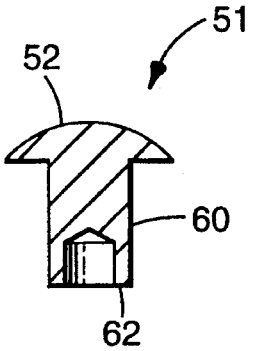
Fig. 6A PRIOR ART
FIG. 6A is a cross-sectional view of the fastener of FIG. 6 prior to flaring.
Figure 7:
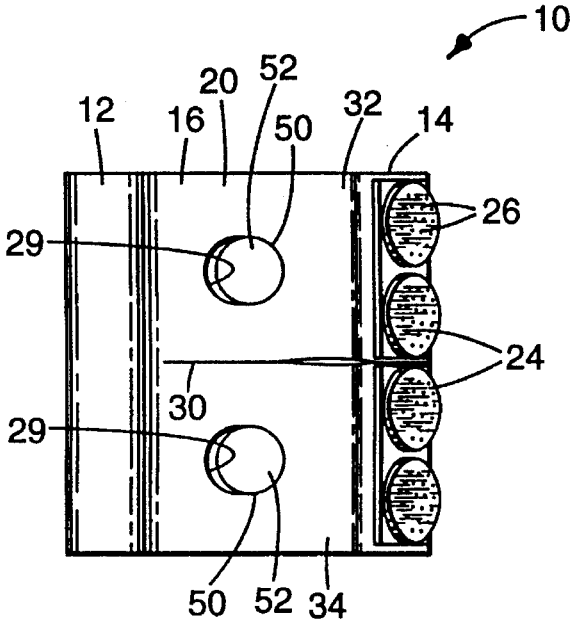
FIG. 7 is a top plan view of a peening flap incorporating a known fastening means and exhibiting premature failure.
Figure 8:
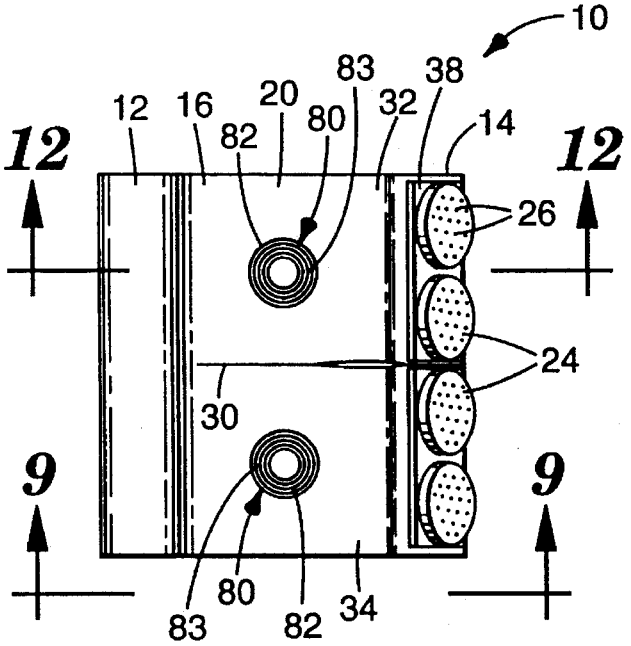
FIG. 8 is a top plan view of one embodiment of a peening flap and fastener according to the present invention.

Strap 16 used in flap 10 of the present invention is formed of a material having a high flexural endurance and shape retention sufficient to withstand the impact caused by peening while retaining peening particle support bases thereon and to return the peening particles to position for further peening impacts. The fastener 80 of the present invention may advantageously be used with straps of many different materials or compositions, including, but not limited to, canvas, rubber, rubber composites, flexible metals, spring metals, and leather. A preferred material for strap 16 includes a fabric substrate or sheet material coated thereon with a plurality of coating layers, at least one coating layer including a linear polyurethane elastomer. The term "fabric" as used herein generally refers to a base substrate of fiber, yarn or other flexible material, whether random, non-woven, woven, knitted or braided, and upon which various polymers are applied by coating or calendaring.

Preferably, a combination of polymers and separate layers is used to form the coating. The most preferred polymer is a polycarbonate-polyether polyurethane. The most preferred polycarbonate-polyether polyurethane used as the linear polyurethane elastomer in one of the layers of the coating is the polycarbonate-polyether polyurethane sold under the trade name "Morthane CA-1225"(Morton International).

The preferred linear polyurethane is made from a mixture of a polycarbonate polyol and a polyether polyol, a diisocyanate compound, and first and second extenders. "Polyol" embraces alcoholic hydrocarbons having at least 2 hydroxyl groups. The polyether polyol and polycarbonate polyol can be used in any relative amounts provided that each are present in the composition. The polyether polyol provides low temperature flexibility characteristics to the polyurethane, while the polycarbonate polyol imparts superior hydrolytic stability. It has been found convenient to use a polyether polyol:polycarbonate polyol ratio in the range of between about 2:1 to about 1:8.

Suitable polycarbonate polyols include those known under the trade names "Duracarb 120" and "Duracarb 122", aliphatic carbonates available from PPG Industries. Other useful polycarbonate polyols include those which are the polymerization product of bisphenol A and diphenyl carbonate, and the polymerization product of bisphenol A and carbonyl chloride, wherein the bisphenol A has hydroxyl groups substituted for one or more methyl hydrogens in each case to provide at least 2 hydroxyl functionalities. The molecular weight of the polycarbonate polyols preferably ranges from about 10,000 to 100,000, more preferably from about 45,000 to 65,000. The equivalent weight (molecular weight divided by OH number) preferably ranges from about 300 to 1000.

Suitable polyether polyols useful in the polyol mixture are addition products derived from cyclic ethers such as ethylene oxide, propylene oxide, tetrahydrofuran, and mixtures of these. The polyols known under the trade names "Polymeg 1000" and "Polymeg 2000" are poly(tetramethylene glyol) ethers available from QC chemicals, and are especially preferred polyols. The molecular weight of the polyether polyols preferably ranges from about 10,000 to 100,000, more preferably from about 45,000 to 65,000. The equivalent weight of the polyether polyols preferably ranges from about 300 to 1100.

Generally, polyols having a molecular weight of between about 60 and 500 (and preferably less than about 250) have been found to be advantageous as extenders. Specific polyols useful as extenders include diols such as 1,3-butanediol, ethylene glycol, tripropylene glycol, dipropylene glycol, propylene glycol, and neopentyl glycol; triols such as trimethylol propane, as well as mixtures of these components, can be used. Amines, such as ethylene diamine can also be used as extenders.

Any diisocyanate compound is suitable, with those based on 4,4'-diphenyl methane diisocyanate (MDI) being preferred. The term "MDI" will be used throughout this application to designate diisocyanate compounds primarily based on 4,4'-diphenyl methane diisocyanate. The diisocyanate compound is initially reacted with one of the extenders which has a molecular weight of less than about 500 in a molar ratio of diisocyanate to extender of about 2:1 so as to form a modified diisocyanate component having a functionality of about 2 prior to reaction with the other components. The term "liquid MDI" will be used to designate an essentially difunctional modified MDI component prepared from the reaction of a low molecular weight polyol with an MDI component to form a modified diisocyanate composition which is liquid at room temperature (about 20° C. ). Preferably, the modified diisocyanate is reacted sequentially, first with the polyol mixture, then with the second extender, so that a linear thermoplastic polyurethane elastomer is formed.

The relative amount of modified diisocyanate to polyol typically ranges from about 2:1 to 20:1, and preferably between about 2.5:1 and 8:1. The modified diisocyanate and the second extender enable the polymer to have low temperature processing properties of up to about 20° C. lower compared to those wherein the diisocyanate is not modified. This polymer has elastomeric characteristics and other physical properties which render it suitable for use in coated fabric manufacturing processes, and produces a coated fabric that is flexible, tough, tear resistant, resilient, and has a high flexural endurance as well as good shape retention.

Another preferred group of polymers which may be used as the coated fabric flap material of the flaps of this invention includes linear polyurethane elastomers formed by reacting a diisocyanate compound with an extender component having a molecular weight of 500 or less to form a modified diisocyanate component having a functionality of about 2, and then reacting the modified diisocyanate component with a polyol component and another extender component, either sequentially or together. These elastomers possess a unique, desirable combination of hydrolytic stability, toughness, and flexibility, and can be processed at lower temperatures compared to elastomers prepared from similar compositions wherein the components are reacted by a "one-shot" process or by a polyol-isocyanate prepolymer process. Further details on these elastomers and their preparation can be found in U.S. Pat. No. 5,013,811, the content of which is expressly incorporated herein by reference.

These polyurethanes may also be crosslinked by adding a crosslinking agent such as an organic isocyanate compound having an isocyanate functionality of at least 2 to increase the stiffness of the resulting coated fabric. Suitable organic isocyanate compounds include aromatic, aliphatic, and cycloaliphatic polyisocyanates and combinations thereof. Representative of these types are the diisocyanates such as m-phenylene diisocyanate, 2,4-toluene diisocyanate, 2,6-toluene diisocyanate, mixtures of 2,4- and 2,6-toluene diisocyanate, hexamethylene diisocyanate, tetramethylene diisocyanate, cyclohexane-1,4-diisocyanate, hexahydrotoluene diisocyanate (and isomers), naphthalene-1,5-diisocyanate, 1-methoxyphenyl-2,4-diisocyanate, MDI, 4,4'-biphenylene diisocyanate, 3,3'-dimethoxy-4,4'-biphenyl diisocyanate, 3,3'-dimethoxy-4,4'-biphenyl diisocyanate, 3,3'-dimethyl-4,4'-biphenyl diisocyanate and 3,3'-dimethyldiphenylmethane-4,4'-diisocyanate; the triisocyanates such as 4,4',4"-triphenylmethane triisocyanate, and toluene 2,4,6-triisocyanate; and the tetraisocyanates such as 4,4'-dimethyldiphenylmethane-2,2', 5,5'-tetraisocyanate and polymeric polyisocyanates such as polymethylene polyphenylene polyisocyanate. Especially useful due to their availability and properties are toluene diisocyanate, MDI, and polymethylene polyphenylene polyisocyanate.

Other polymers may also be included in the coating, such as other polyurethanes or elastomers such as nitrile, natural or neoprene rubber. In the specific formulations described herein, a polyester polyurethane having a Shore A hardness of 90 or greater is preferred for use in combination with the polyurethane elastomers described above. In certain applications, multiple layers of that polyester polyurethane can be used to form the desired coating. The hardness of the polyester polyurethane is greater than what is normally used in conventional polyurethane top coats for coated fabrics, since flexibility is typically desired in conventional coated fabrics. In some high-intensity roto-peen applications, however, it has been found that a more rigid coated fabric is necessary to provide increased service life. Thus, harder polyester polyurethanes are used, and crosslinking agents may be included to further increase the stiffness of the final coated fabric used as the flap material. The resultant fabric is capable of providing a significantly increased service life compared to the softer, more flexible counterparts.

Moreover, any of the polyurethanes may be strengthened by adding a crosslinking agent, such as the organic isocyanate compounds having isocyanate functionality of at least 2, described above, to increase the stiffness of the resulting coated fabric. The overall stiffness or flexibility of the resulting fabric can therefore be varied by increasing or decreasing the number of layers utilizing crosslinked polyurethanes. Additionally, different layers of these polyurethanes are preferably utilized in the coated fabric to provide the correct combination of stiffness and mechanical properties, as explained in further detail below. When symmetrical layers and coating materials are provided on each side of the fabric substrate, the coated fabric is described as "balanced", while an "unbalanced" coated fabric would include a different number of layers, different coating materials, or different thicknesses in each side of the fabric thereof. It should be understood that both balanced and unbalanced coated fabrics used to form the peening flaps of the present invention are within the scope of this invention.

Coated fabrics utilize a fabric substrate to give the coated fabric integrity, as illustrated in FIG. 1 of U.S. Pat. No. 5,298,303, entitled "Fabric Structure for Severe Use Applications,", the disclosure of which is incorporated herein by reference. The fabric material may include one or more layers or arrangements of fibers of various materials, weights, thicknesses and widths depending on the service life of peening flaps desired. The various configurations of fabric are generally known in the art and will not be explained in greater detail here. While the fabric providing the best mechanical properties required for the peening flap construction of the present invention has been found to be a woven nylon fabric, the invention is not limited to flaps made from any woven fabric, and encompasses flaps made from non-woven substrates as well. In addition, other natural or synthetic staple or non-staple fibers or yarns could be used in a mat, woven, knitted or braided configuration to form the fabric substrate.

When woven fabrics are to be used, polyester or fiberglass fibers or blends thereof are suitable, as well as nylon. Polyester fibers or fabrics have less moisture absorption and better long term heat aging compared to nylon, and would be preferred for applications requiring such properties. By testing the materials in accordance with the method described, infra, the best materials, structure, denier, etc. of the fibers or yarns for the fabric substrate can be determined for the particular peening operation.

For example, a two ply 840 denier high tenacity nylon 66 filament yarn woven into a basket weave construction consisting of about 34 warp (length direction) and about 34 weft (cross width direction) yarns has been found to provide the optimum mechanical properties of compression and density required for the fabric substrate of the high-intensity peening flaps. The weight of the uncoated fabric preferably ranges from about 180 to about 415 grams per square meter ("gsm"), preferably between 215–360 gsm and most preferably about 290 gsm. Also, the denier of the nylon yarn can vary over a range of about 400 to 1100, preferably about 600 to 1000, depending upon the number of warp and weft fibers. When rivet-type peening particle support bases are used, it has been found that a 21 warp by 21 weft, 840 denier, 175 gsm woven nylon fabric was insufficient, as was a 38 warp by 38 weft, 1050 denier, 420 gsm woven nylon fabric.

To the fabric substrate there is preferably applied a pretreatment chemical to aid in adhesion of subsequently applied coating layers. The pretreatment step can consist of applying an aziridine compound by, for example, a dipping process. A preferred aziridine compound is that sold under the trade name "CX-100", which is available from ICI Americas, Wilmington, Del.

The aziridine compound is mixed with an aqueous or organic solvent, such as water or toluene, in an amount of about 3 to 10 and preferably about 6 to 8 parts by weight solvent to 1 part aziridine, and the fabric is dipped into the mixture. Then, the wetted fabric is heated in an oven to a sufficient temperature to drive off the solvent. Generally, about 195 to 230° F. (90 to 110° C. ) is sufficient, depending upon the specific solvent used.

It has also been found that coating adhesion to the fabric can be substantially increased by heating the aziridine wetted fabric to higher temperatures of at least about 300° to 350° .F (i.e. 150° to 170° C. ). It is believed that such higher temperatures cause the aziridine ring to open and, thus, become much more reactive toward the subsequently applied coatings. When heated to these temperatures, an aziridine treated nylon fabric which is subsequently coated with a linear polyurethane elastomer exhibits at least about 100–200% improvement in peel strength (e.g., increases the peel strength from about 135 to about 270–410 Pa).

To the pre-treated fabric substrate is provided a single or plurality of layers which each include one or more coatings of polymeric materials. The overall thickness of each of the layers will generally be sufficient to give a final coated fabric thickness of between about 0.05 cm and 0.15 cm. Individual layers can be calendered, although adhesion to the fabric may be slightly reduced as each individual layer increases in thickness. For optimum adhesion, the coated fabric thickness is built up in layers, with each layer being deposited in one or preferably a plurality of coatings of the desired polymeric material. Also, by depositing a plurality of coatings, it is possible to include the crosslinking agent in one or more of the coatings for increasing the stiffness of the fabric. The weight of the coated fabric preferably ranges from about 500 to 1500 gsm, more preferably from about 800 to 1200 gsm.

A preferred construction of the coated fabric material used in the flaps of this invention has a polyester polyurethane which contains a crosslinking agent, as the first layer adjacent each side of the pre-treated fabric, followed by a layer of the preferred polycarbonate-polyether polyurethane (uncrosslinked) polycarbonate adjacent each polyester polyurethane layer.

Finally, a layer of polycarbonate-polyether polyurethane which contains a crosslinking agent is applied adjacent each uncross-linked polycarbonate-polyether polyurethane layer. The outermost layers can be a polyester polyurethane with or without the crosslinking agent.

If desired, any or all of layers can contain pigments, fillers, stabilizers, or other conventional additives at conventional levels normally found in this type of coating composition. It has been found that the addition of a small amount of a silicone compound, such as that sold under the trade name "L-42"(Union Carbide), has been found advantageous to increase the resiliency and tear strength of the overall fabric. This material is used in an amount of about 0.1 part to 2 parts based on 100 parts polymer, with 0.5 to 1 part being preferred. This enables the fabric to provide increased performance with respect to its ability to retain peening particle support bases upon the fabric under severe operating conditions.

While each layer may be composed of a different polymer composition, it is advantageous that at least one and preferably more than one layer contain the preferred polycarbonate-polyether polyurethane. Of course, several layers can contain this same polyurethane composition, either with or without the crosslinking agent, while other layers may contain any one of the different polymer materials described above. A preferred polyurethane material for one or more of the other layers is a polyester polyurethane having a durometer hardness of 90 eShore A or greater, such as the polyester polyurethanes known under the trade names "Estane 5707-F1"(B. F. Goodrich) or "Rucothane CO-A-5054"(Ruco Chemicals). Some layers of these other polyurethanes may also include an organic isocyanate compound having isocyanate functionality of at least 2 to form crosslinked polyurethanes. As noted above, the isocyanates are added to the polyurethanes to increase stiffness of the resulting composite structure. A wide variety of combinations of layers of different polyurethanes or other polymeric materials can be used, depending upon the particular application of the coated fabric. Also, as noted above, each layer is made from a plurality of coats of the desired material, or of mixtures of different but compatible polymeric materials.

The coated fabric can also be produced by calendaring the polymeric materials onto the fabric, where the individual components of each layer are initially prepared in sheet form and then are bonded together between rollers under heat and pressure. In this process, the crosslinking component is generally not included in the layers. When calendaring this material, the fabric substrate is initially coated with the aziridine compound and the first few layers of polymer on one side prior to calendaring the remaining layers to the initially coated fabric. Thereafter, the material can be turned over, and the other side of the substrate coated with the first few layers of polymer for the side, followed by the calendaring process to add the remaining layers to final dimension.

When using a calendaring process to apply the coatings to the fabric, it is advantageous to add a millable linear polyurethane elastomer having at least one pendant $$-\overset{|}{C}=\overset{|}{C}-$$

group to lower the processing temperature of the coating material by at least about 6° C. A preferred material is the millable linear polyurethane elastomer sold under the trade name "Morthane CA-1217", although those sold under the trade names "Vibrathane V-5008" (Uniroyal Chemical), "Millathane HT" (TSE Ind.) and "Adiprene E" (Uniroyal Chemical) could also be used. The strength of the millable materials can be enhanced by adding a vulcanizing agent, preferably comprising sulfur and one or more sulfur compounds, and by vulcanizing the final product at conventional vulcanization temperatures (110–140° C. ).

The material of the peening particle support bases 24 must be able to withstand high cyclic bending and impact stresses while resisting deformation during use. It is important to note that the bending and impact stresses during use are cyclic (i.e., repeated) since ultimate separation of head from shank of the rivets is the result of fatigue (cyclic stresses causing failure at lower stress levels than would be expected to cause failure under static loading). In addition, the rivet material must be sufficiently ductile to allow the required deformation to be cold formed and for fastening to the strap. When using previously known elongate strap materials with rivet-type support bases made from low carbon steel such as an AISI 1006 (American Iron and Steel Institute) carbon steel it was found that the strap material required replacement prior to replacement of the rivets. However, with the use of linear polyurethane elastomers as coating material for the fabric scrim, the low carbon steel rivets have become the life limiting feature of the flaps used for high-intensity peening. The upper exposed surface of the low carbon steel becomes severely hardened during the brazing of the abrasive particles to the support bases. When a nickel (Ni) alloy brazing compound is used to attach abrasive particles to the rivets, the surface of the rivet that is exposed to the braze alloy is hardened as well as a region extending about 0.5 mm below this surface. The hardness of the rivet is more affected, however, by the lower carbon (C) content of low carbon steels, which is insufficient (under normal circumstances) to allow metallurgic transformation to a harder structure by heat treatment. This lower hardness may manifest itself in the abrasive peening particles being forced toward the center of the support base, creating a flattened surface profile, and consequently reducing the rate of scale or concrete removal during peening.

For this reason, peening particle support bases 24 (prior to brazing) are preferably carbon steels having from about 0.08 to about 0.34 weight percent C, more preferably AISI 1021 steel (0.18–0.23 weight % C) having from about 0.0005% to about 0.003 by weight boron (B) added thereto. However, the fastener 80 of the present invention may advantageously be used on peening flaps having peening particle support bases of many different compositions and geometries. 10B21 steel allows for hardening by heat treatment (via a metallurgical transformation), and exhibits good "hardenability" that is it can be through hardened while 1006 cannot. It appears that 10B21 contains just enough C and B (preferably at least 0.002 wt % B) to be a hardenable alloy via heat treatment while having the maximum allowable C content to be formed using the current two stroke cold heading (forming) machine used to make the rivets, and the machine used to flare the shank 25 of the rivets.

Tempering the rivets via heat treatment after brazing the abrasive particles thereto can affect hardness. Depending on the power and of type machine used to flare the shank of the rivet, the preferred center hardness is produced by adjusting the tempering temperature. A high tempering temperature (e.g. 700° C.) produces a hardness of about 70–100 HRB (Rockwell Hardness, B scale), while lowering the tempering temperature to about 400° C. produces hardness of about 30–40 HRC (Rockwell Hardness, C scale). Thus, one preferred tempering temperature ranges from about 375° C. to about 425° C., more preferably about 400° C., when a harder rivet is desired. A radial riveting machine known under the trade name "Baltec", available from Bracker Corporation, Pittsburgh, Pa., which uses a maximum riveting pressure of 1700 daN, may be used for rivets tempered at high temperatures, while low temperature tempering may require higher riveting pressures.

The peening particles 26 are typically of a refractory-hard, impact fracture-resistant material, and they are metallurgically joined to the exposed face of the support bases 24. Refractory-hard cemented tungsten carbide shot known under the trade name "Grade 44A", available from Carboloy, Inc. (now known as Sandvik Hard Materials), of Warren, Mich., have been found to have an excellent combination of the preferred properties. This particular tungsten carbide includes a binder having from about 8–12 weight percent Co. However, other cemented carbides, for example, TiC and TaC; ceramic materials, for example, $B_4C$ and hot-pressed alumina as well as other wear-resistant, refractory-hard peening particles are also useful. The particle support bases and the peening particles must, of course, be compatible for metallurgical joining. Such bonding may be accomplished by brazing, casting the peening particles in place in the support base, sintering, or any other available method for forming the required bond. Preferred is brazing, using a brazing alloy having about 80–85% by weight Ni, about 3% B, about 7% Cr, about 3.5% Fe, about 4.5% Si, with traces of Al, C, Co, P, S, Se, Ti, and Zr. One commercially available brazing alloy meeting these specifications is that sold under the trade name "Amdry 770" a powder commercially available from Sulzer Plasma Technik, Inc., Troy, Mich. This brazing alloy has 0.05% maximum Al; 2.75% minimum to 3.50% maximum B; 0.06 maximum C; 0.10 maximum Co; 5.0% minimum to 8.0 maximum Cr; 2.5% minimum Fe to 3.5 maximum Fe; 0.02% maximum P; 0.02 maximum S; 4.00% minimum to 5.00 maximum Si; 0.005 maximum Se; 0.05 maximum Ti; 0.05 maximum Zr; balance Ni. This brazing alloy has powder particle size distribution of 90% minimum at −140 mesh (+105 micrometers) and 50% maximum at −325 mesh (+45 micrometers).

Other braze alloys are possible for use but have limitations which make their use less than optimal. Copper braze alloys are limited by several factors, including their high fluidity, which could lead to infiltration of copper into the tungsten carbide shot. The vaporization temperature of liquid copper braze alloys is low enough in vacuum brazing furnaces so that argon atmospheres must be used. Silver braze alloys have poor mechanical properties and are not suitable for most abrasives applications. They also melt around 850° C. and would become remelted during subsequent heat treatment processes. Thus, nickel braze alloys are preferred. They are easy to use, having wide melting range, and become fully liquid at about 1000° C. because of the Si and B. These elements diffuse into the base metal or vaporize, however, and remelting requires a considerably higher temperature.

Figure 16:
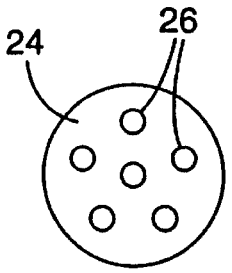
FIG. 16 is a top plan view of one embodiment of a peening particle support base for use with the peening flap of the present invention.
Figure 17:
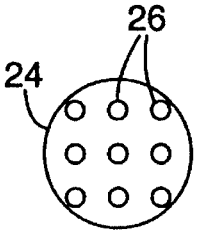
FIGS. 17–19 are views like FIG. 13 of alternate embodiments of the peening particle support.
Figure 18:
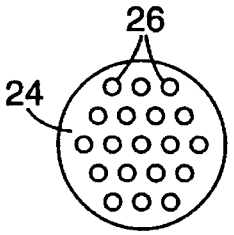
Figure 19:
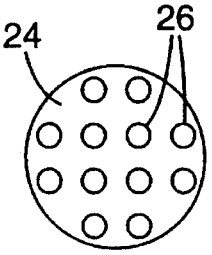

FIGS. 16–19 show plan views of four embodiments of peening particle support base 24. FIG. 16 shows six peening particles 26 arranged in a star pattern. FIG. 17 shows nine peening particles arranged in a centered square pattern, while FIGS. 18 and 19 illustrate two other patterns found useful. Of course, other arrangements and numbers of peening particles 26 are possible and deemed within the scope of the present invention.

The exposed surface of peening particle support base 24 has dimples adapted to receive generally spheroidal peening particles 26 during brazing. The peening particles 26 are preferably spheroidal, although other shapes may be used. Spheroidal particles typically have one hemisphere within a dimple and the other hemisphere out of the dimple. The dimples can be of the same or different diameters on a given peening particle support 24 to accommodate different diameter peening particles 26, but the particles and dimples are preferably all the same diameter on a given support base for ease of manufacture and to lower manufacturing cost. The diameter of the particles and the dimples into which they are placed can range from about 0.010 to 0.080 inches (0.252 to 2.03 mm), more preferably from about 0.040 to 0.064 inches (1.02 to 1.63 mm). The embodiments of FIGS. 17 and 18 have dimple/particle diameters of 0.044 inches (1.11 mm), while the embodiments shown in FIGS. 16 and 19 preferably have dimple/particle diameters of 0.064 inches (1.63 mm). The larger diameters are used when more aggressive peening action is required, such as to remove heavy oxide scale or coatings from metal, and concrete surface preparation. The exposed surface of peening particle support base 24 of FIG. 16 has a diameter of 0.500 inches (1.27 cm), while that of FIG. 17 has a diameter of 0.410 inches (1.04 cm), that of FIG. 18 has diameter of 0.465 inches (1.18 cm) and that of FIG. 19 has diameter of 0.500 inches (1.27 cm). Other head diameters may be preferable depending on the particular operation.

A commercial convention has been developed to identify various peening particle support bases 24 provided on Heavy Duty Roto Peening Flaps available from Minnesota Mining and Manufacturing Company, St. Paul, Minn. as follows: Type "A" particle support has a head diameter of 0.500 inches (1.27 cm) with six peening particles 26 having a diameter of 0.064 inches (1.6 mm); Type "b" particle support has a head diameter of 0.410 inches (1.04 cm), with nine peening particles of 0.044 inch (1.1 mm) diameter; Type "C" particle support has a head diameter of 0.465 inches (1.18 cm) with nineteen peening particles 26 of 0.044 inch (1.1 mm) diameter, and Type "D" particle supports have a head diameter of 0.500 inch (1.27 cm) with 12 peening particles 26 of 0.064 inch (1.6 mm) diameter. It will be appreciated that variations in peening particle size, pattern, etc., are within the scope of the present invention.

Referring now to FIGS. 8–10 and 12, there is illustrated a first embodiment of a high-intensity peening flap 10 and fastener 80 of the present invention. However, it is understood that the fastener 80 of the present invention may advantageously be employed with peening flaps 10 having a different configuration from those described herein, including, but not limited to, single continuous loop straps cut from a tube of strap material.

Peening flap 10 comprises an elongate strap 16 having in this embodiment first and second overlapping end portions 18 and 22 fastened together and to medial strap portion 20 by fastener 80. Four peening particle support bases 24 of Type "A" described above are retained on strap 16 by washer 23 and flared shank 25. A plurality of peening particles 26 are provided on the exposed face of each support base. In the illustrated embodiment, the peening particle support bases 24 are mechanically fastened to strap 16 by being formed as a rivet having a head portion and a shank 25, the rivets positioned on peening end 14 of the flap 10.

Shank 25 is passed through an aperture in one layer of strap 16 (as well as through apertures in interior and exterior supports straps 36 and 38). Washer 23 is then slipped over the rear of shank 21, and the rear of shank 21 is thereafter flared to securely fasten the support base to strap 16. Exterior strap 38 is positioned between a portion of the exterior surface of strap 16 and the non-exposed surface of support base 24. Similarly, interior support strap 36 is adjacent a portion of the interior surface of strap 16, between the interior surface and washer 23.

Figure 9:
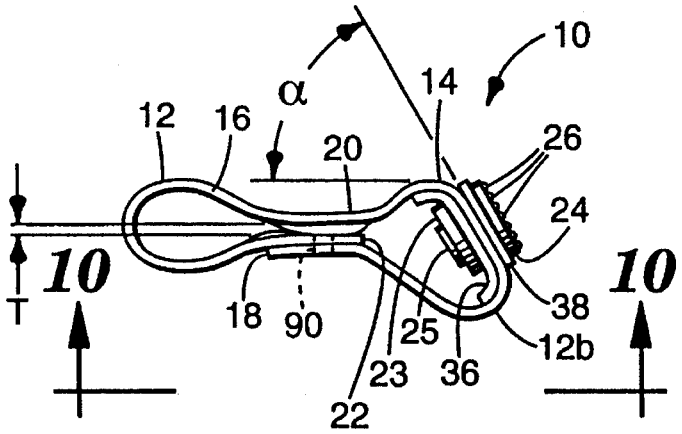
FIG. 9 is a side view of the peening flap of FIG. 8 taken along line 9—9.
Figure 10:
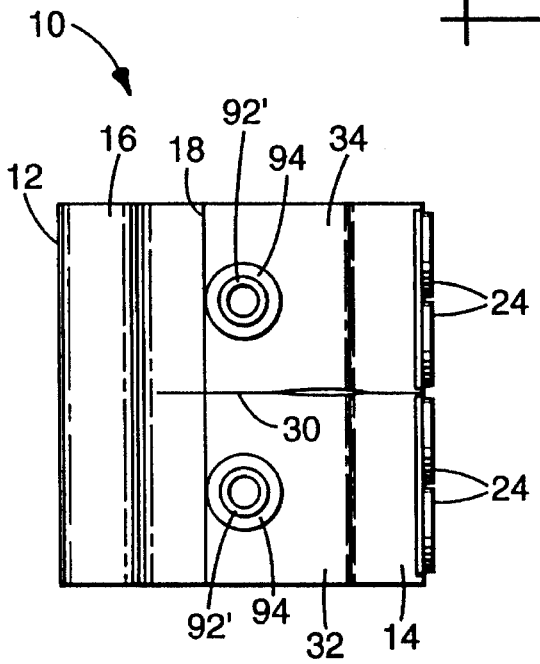
FIG. 10 is a bottom plan view of the peening flap of FIG. 9 taken along line 10—10.

Fasteners 80 are preferably positioned equidistant from a slit 30 in the flap 10 (thus creating first portion 32 and second portion 34) and positioned generally on a line between paired support bases 24 and parallel to the slit. The slit (or slits, if more than two flap portions are desired) allows peening action by the peening supports 24 on first portion 32 independent of that of peening supports on second portion 34. As illustrated in FIG. 9, the peening faces of the support bases 24 are preferably inclined to the length of the strap at an acute angle $\alpha$, the angle ranging from about 25° to about 80° more preferably ranging from about 45° to about 65°.

The following dimensions of peening flap 10 have been found advantageous. The strap portion 16 is preferably approximately 2.00 inches (5.08 cm) wide by 5.50 inches (13.97 cm) long prior to assembly. Upon assembly, the peening flap 10 is preferably approximately 2.00 inches (5.08 cm) wide by 1.875 inches (4.76 cm) long. Slit 30 extends approximately 1.313 inches (2.67 cm) into the flap 10 from the direction of peening end 14. Two exterior straps 38, one on each side of slit 30, are each approximately 0.500 inches (1.27 cm) wide by 1.00 inch (2.54 cm) long. Two interior straps 38, one on each side of slit 30, are each approximately 1.00 inch (2.54 cm) wide, with approximately 0.500 inches (1.27 cm) on each side of the central axis of shank 25, so as to extend to elbow 12b. *Each interior strap 38 is approximately* 1.00 inch (2.54 cm) long to extend from proximate slit 30 to proximate the edge of flap 10.

Figure 11:
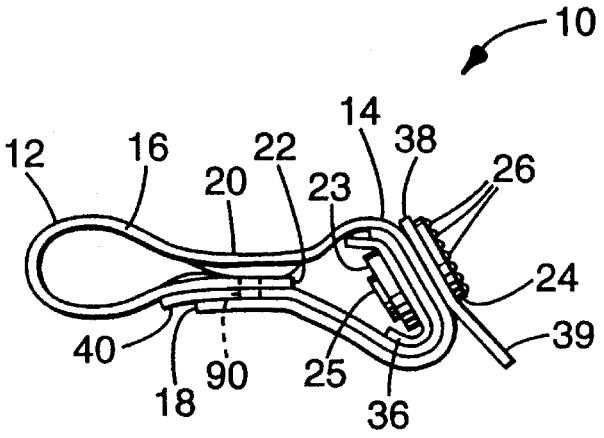
FIG. 11 is a view like FIG. 9 of an alternate embodiment of a peening flap and fastener according to the present invention.

A second embodiment of peening flap 10 and fastener 80 of the present invention is illustrated in FIG. 11. Similar reference numerals are used in FIG. 11 to denote similar structural components of the embodiment of FIGS. 8–10. However, the embodiment shown in FIG. 11 differs in two significant respects from the embodiment of FIGS. 8–10: the addition of a wear pad 40 and an extended portion of exterior support strap 38, referred to as fin 39. These features increase the life of the flap construction for excessively harsh operations such as concrete resurfacing. Wear pad 40 provides another layer of coated fabric, which may be composed of the same or different material as the strap 16 materials discussed above. Preferably, wear pad 40 is composed of the preferred linear polyurethane elastomer coated nylon fabric described above. Wear pad 40 is preferably adjacent strap 16 inside the peening end 14 of flap 10, and follows the contour of strap 16 so that one end of wear pad 40 is sandwiched between the ends of strap 16, as shown in FIG. 11, although other structures are considered within the scope of the invention. For example, wear pad 40 could be placed externally, i.e., sandwiched between exterior support strap 38 and strap 16, and follow the contour of strap 16 as would an interior wear pad. Shank 25 of peening particle support 24 passes through an aperture in pad 40 whether pad 40 is external or internal.

Fin 39 is essentially an extension on the trailing end of exterior support strap 38. Tests under conditions deemed representative of actual use conditions have shown that the area generally designated as elbow 12*b* has a tendency to wear excessively during high-intensity peening of concrete and other materials having an inclination to fragment under the pulverizing action of the peening particles. It was also theorized that when many flaps are loaded onto a hub, as shown in FIG. 1, the "tailgating" of the immediately succeeding flap against its leading neighbor flap causes a high wear area at 12*b* to form. Fin 39 interferes with this recoil, while wear pad 40 helps cushion the area adjacent elbow 12*b*, leading to longer flap life.

The features just presented may be combined to achieve optimum wear resistance of the flap. Some possible combinations include a "conventional" flap with the addition of the fin; fin plus internal wear pad; fin plus external wear pad; no fin but internal and external wear pad; etc. It is surmised that the best construction will depend on the operation, but at present is that having an external wear pad and a fin.

Fastener 80 of the present invention should be sized and configured to provide the following features. It is desirable that the head of fastener 80 have a rounded edge and an included angle of greater than 90 degrees at the intersection of the bottom surface of the rivet head with the side or top surface of the rivet head, to minimize the likelihood that the head of the rivet will tear into or otherwise damage the strap 16 of flap 10. Furthermore, fastener 80 should continuously provide a desired amount of compression to the fastened portions of the strap 16, and be able to maintain compression over periods of prolonged use of the peening flap 10. The fastener should be sized and arranged to minimize its interference with the bending of peening flap 10 during use. Likewise, the materials of rivet portion 81 and washer 94 of fastener 80 should be selected to provide the above features.

Figure 12:
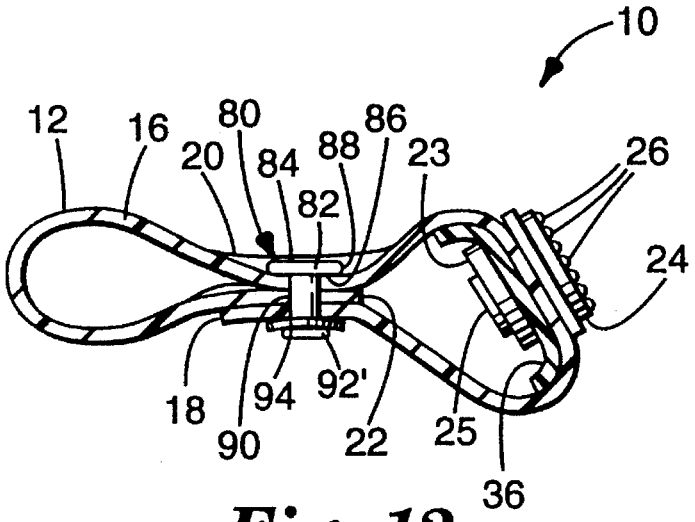
FIG. 12 is cross-sectional view taken along line 12—12 of the peening flap of FIG. 8.
Figure 12A:
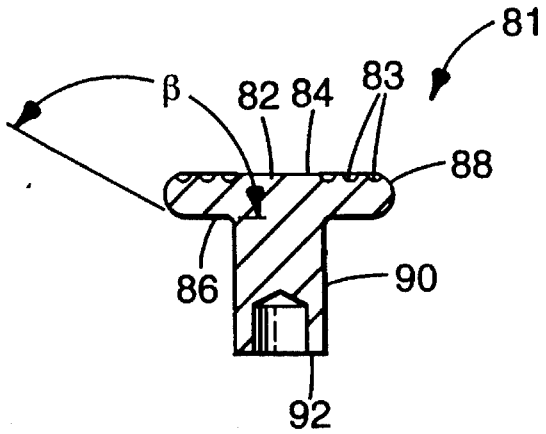
FIG. 12A is a cross-sectional view of the fastener of FIG. 12 prior to flaring.

Fastener 80 of the present invention includes rivet body 81 and washer 94. Rivet 81 includes head 82 at one end of shaft 90. Head 82 includes a generally planar top surface 84 and a generally planar bottom surface 86. In the embodiment shown, top surface 84 has a plurality of concentric circular grooves 83 which are useful in manufacturing rivet 82 as discussed below, but which are not presently believed to affect the operation or life of peening flap 10. Top and bottom surfaces 84 and 86 are parallel to one another and perpendicular to the longitudinal axis L of shaft 90. Top and bottom head surfaces 84 and 86 are joined at their peripheries by head side surface 88. Head side surface 88 extends around the circumference of head 82 and is arcuate in the direction parallel to the shaft 90. As seen in FIG. 12A, this forms an included angle $\beta$ of greater than 90 degrees at the juncture of side surface 88 with bottom surface 86 which helps minimize tearing of the strap 16 by the head 82. While a discreet side surface 88 is illustrated, it is also possible that the top surface 84 itself intersects with bottom surface 86 in such a manner as to provide the desired juncture with an included angle of greater than 90 degrees. The top surface 84 of rivet head 82 may be of any desired geometry, provided it does not adversely affect the intersection between the side surface 88 and bottom surface 86. For example, it may be concave, convex, grooved, or any other shape which does not interfere with the intersection between the side surface 88 and bottom surface 86. At the end of the shaft 90 opposite head 82 is fold down stem 92. FIG. 12A illustrates the fold down stem prior to flaring. FIG. 12 illustrates the fold down stem after it has been flared to form rollover flare 92'. Rollover flare 92' secures washer 94 on shaft 90.

Head 82 may be round as illustrated, which provides at least the following advantages. A round head does not have corners which could tear into strap 16 during operation, thereby reducing the life of the peening flap 10. If a polygonal head is used, a near round shape having, for example, 8, 12 or more sides with less severe corners would be preferred. It possible to use head shapes having fewer sides, such as square or triangular, but the corners of such configurations become more apt to tear into strap 16 as fewer sides are employed. Furthermore, a round head has minimal interference with the bending of the peening flap 10 during operation. The peening flap 10 tends to bend during operation in response to having peening support bases 24 driven against the surface to be abraded. It may be possible to employ an oblong, oval, rectangular, or other non-round head 82. Such a head would not be expected to negatively affect the life of strap 16 provided the longer dimension of such a head was perpendicular to slit 30, so as to minimize interference with the bending of the peening flap 10 during use, and further provided that any corners be oriented relative to the bending of flap 10 to minimize the chance of the corner digging into strap 16.

Fastener 80 must be strong enough to secure the overlapping portions of strap 16 during high intensity peening operations. Fastener 80 must also be able to withstand the cyclic stress caused during peening. Suitable materials for the rivet portion 81 of the fastener 80 include, but are not limited to, thermosetting polymers or thermoplastics with glass fiber or glass powder reinforcements, brass, aluminum, copper and steel, with low carbon steel being preferred. Of the low carbon stainless steels, those having AISI designations in the range of 1006 to 1010 low carbon steel are preferred, with AISI 1010 CR low carbon steel being the most preferred.

It has been found that the rivet portion 81 of fastener 80 may advantageously have the following dimensions. The diameter of head 82 is preferably 0.420 to 0.440 inches (10.7 to 11.2 mm), with top surface 84 and bottom surface 86 preferably being 0.054 to 0.064 inches (1.37 to 1.63 mm) apart. The diameter of shaft 90 is preferably 0.182 to 0.188 inches (4.62 to 4.78 mm), with fold down stem 92 preferably being 0.165 to 0.215 inches (4.19 to 5.46 mm) long. The overall length of the rivet 81 from top surface 84 to the free end of shaft 90 is preferably 0.360 to 0.390 inches (9.14 to 9.91 mm). The radius at the intersection of shaft 90 with bottom surface 86 is preferably at least 0.030 inches (0.762 mm), as is the radius at the intersection of bottom surface 86 with side surface 88. The above rivet 81 is suitable when fastening three overlapping portions of strap 16. If peening flap 10 includes four overlapping portions of strap 16 fastened together, it is preferable to use a rivet 81 having an overall length of 0.440 to 0.470 inches (11.2 to 11.9 mm).

Rivet portion 81 may be formed from wire stock of AISI 1006 to 1010 steel by a single-die two-punch process as follows. The wire stock is the same diameter as the diameter of the shaft 90. The wire stock is punched twice against the die to form the head 82. The die includes a die surface against which top surface 84 of the rivet head is formed, however the die does not include a surface against which the side surface 88 is formed. Therefore, when the wire stock is punched against the die to form the top surface 84, the profile of the side surface 88 and the intersection of the side surface 88 with the bottom surface 86 is a result of the material flow during cold deformation of the wire stock as it is spread out against the die. The die includes concentric holding rings which form concentric grooves 83 in the top surface 84 of the rivet head. These rings are known in the art to regulate the flow of metal in the radial direction as the head 82 is formed against the die, helping form a uniform and concentric head 82. A piercing pin forms a hole in the free end of shaft 90 during the first punch against the die, thereby forming fold down stem 92. After forming the rivet 81, it is preferable to stress relieve it by heating it in a vacuum at 1150°–1200° F. (620°–650° C. ) for 1.5 hours.

Back up washer 94 must be strong enough to withstand the stresses imparted by high intensity peening. Washer 94 should also be capable of sufficient elastic deformation to impart and maintain the desired compression on the overlapping portions of strap 16. By maintaining the overlapping portions under compression, fastener 80 minimizes the amount of peening debris which becomes lodged between the fastener 80 and the overlapping strap portions, and between the strap portions themselves. Adequate compression also helps attenuate slipping of the fastened strap portions relative to one another and relative to fastener 80. Both of these affects of compression help reduce the premature failure of strap 16 as described earlier. The elasticity of washer 94 also acts to limit the compression imparted by the fastener on the flap fabric when the fastener is flared.

By imparting sufficient elastic deformation into washer 94 upon assembly of fastener 80, the washer 94 will be capable of maintaining compression on the fastened portions of strap 16 even if the combined thickness of the fastened portions is significantly reduced during prolonged use of peening flap 10. As the strap portions thin, washer 94 is urged to return to its initial undeflected state because of its substantial elastic deformation. While known metal washer 64 of fastener 50 is technically capable of elastic deformation, such deformation is insufficiant to substantially affect the strap portions over a wide range of decreased thickness, and compression is quickly lost as the combined thickness of the fastened strap portions begins to decrease with use. This is because the small amount of elastic deformation of metal washer 64 is quickly used up as the fastened portions of the strap 16 become thinner, and the washer 64 quickly returns to its free state. As the strap portions continue to thin, known fastener 50 with metal washer 64 is incapable of compensating for the reduced thickness, and can no longer impart compression into the fastened portions of strap 16.

In contrast, washer 94 of the present invention is capable of substantially more elastic deformation than the prior metal washer 64, and washer 94 is therefore capable of maintaining compression on the fastened strap portions for a greater degree of thinning than prior metal washer 64. This is because elastic washer 94 will not use up its elastic deformation and return to its free state despite substantial thinning of the fastened strap portions. Elastic washer 94 thereby imparts compression through its greater elastic deformation for a greater degree of strap thinning.

Figure 13:
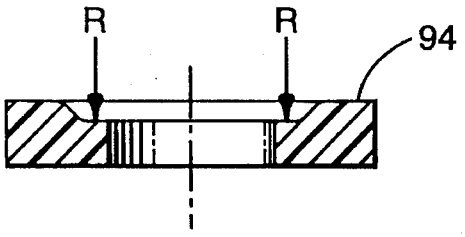
FIG. 13 is a cross-sectional view of the washer of FIG. 12, illustrating a first mode of elastic deformation of the washer.
Figure 14:
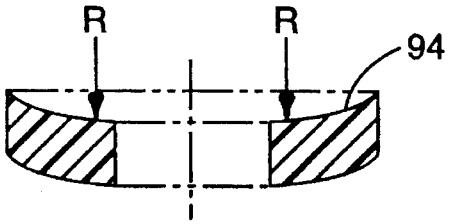
FIGS. 14–15 are views like FIG. 13 illustrating second and third modes of elastic deformation, respectively.
Figure 15:
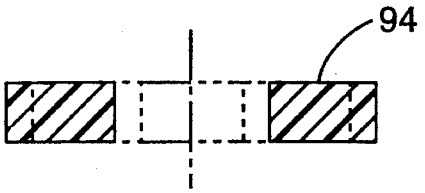

Elastic washer 94 undergoes substantial elastic deformation in at least three known modes as illustrated in FIGS. 13–15. As seen in FIG. 13, one mode of elastic deformation is elastic compression of washer 94 in the area of contact by rollover flare 92', indicated as R in FIGS. 13–15. A second mode of elastic deformation is "dishing" or bending as illustrated in FIG. 14. A third mode of elastic deformation is radial and circumferential expansion of washer 94 as seen in FIG. 15. Additional modes of elastic deformation may be possible.

The relative amounts of these modes may vary with particular applications without loss of effectiveness of fastener 80, and all three modes need not be present in a particular application. What is important is that the total elastic deformation of washer 94 be sufficient to maintain compression on the fastened strap portions despite significant reduction in combined thickness of the fastened portions of strap 16. Furthermore, it is acceptable that the washer 94 also undergo some amount of plastic deformation, provided there remains sufficient elastic deformation.

Washer 94 should have a modulus of elasticity allowing it to have sufficient elastic deformation. Washer 94 should preferably have a modulus of elasticity significantly less than known metal washer 64, and should preferably be less than $2.0\times10^6$ psi ($1.38\times10^7$ kPa). Washer 94 may more preferably have a modulus of elasticity in the range of 10,000 to 600,000 psi ($6.9\times10^4$ to $4.1\times10^6$ kPa), and still more preferably in the range of 210,000 to 425,000 psi ($1.4\times10^6$ to $2.9\times10^6$ kPa). Suitable materials for washer 94 include, but are not limited to, Nylon-6; Nylon-6,6; polypropylene; and polyethylene; and a preferred material is Nylon-6,6 available under the trade name of Zytel 101L from E. I. DuPont de Nemours, of Wilmington, Del. Nylon washer 94 can be stamped or injection molded by a process such as five-point injection molding to minimize the risk of washer 94 cracking during use. It has been found that the washer 94 should have an outside diameter approximately equal to the diameter of rivet head 82 and an inside diameter approximately 0.005 inches (0.127 mm) larger than the diameter of shaft 90 of rivet 81. The following dimensions for washer 94 are preferred: outside diameter of approximately 0.437 inches (11.1 mm), inside diameter of 0.195 inches (4.95 mm), and a thickness of 0.060 inches (1.52 mm).

Flaring the fold down stem 92 sufficiently to achieve a desired length of fastener 80 deflects washer 94 and imparts the initial compressive force on the fastened portions of strap 16. The washer 94 is also elastically deformed as described above. For example, a Nylon-6,6 washer having an outer diameter of 0.437 inches (11.1 mm) in a free state can expand to a diameter of 0.450 inches (11.4 mm) when fastener 80 is secured so as to provide the desired initial compression.

It is also possible to use other elastic fastening means to maintain compression on the fastened portions of strap 16 during use of flap 10. For example, it is possible to use some type of urging means between the rollover flare 92' and washer 94, such as a coil spring, a spring washer or lock washer, or some other type of spring means. With such an arrangement, the spring means may be fabricated of a material having a modulus of elasticity higher than that of polymeric washer 94. It is important that the modulus and geometry of the elastic fastening means together provide a spring rate comparable to the spring rate of washer 94.

It has been known to use an elastic polymeric washer 23 to fasten the peening particle support 24 to the peening flap 10 to solve a different problem from that addressed by the present invention. Prior to the present invention, it has not been known or suggested, nor is there any motivation, to use the polymeric washer 23 to impose or maintain compression of the strap 16 in the area of the peening support bases 24. Nor has tearing of the strap been experienced in the area of the peening support bases 24. Instead, the polymeric washer 23 has been used with the peening particle support bases 24 to prevent cracking that was occurring with metal washers placed on shaft 25 of the peening support. The washer 23 is subject to peening impact forces during the peening operation. Use of polymeric washer 23 alleviated the cracking that the peening impact caused on metal washers 23.

The following ratios of the sizes of the elements of fastener 80 are preferable for imparting and maintaining the desired compression with fastener 80. These ratios are advantageous when employing fasteners having approximately the dimensions described herein. It is possible that the preferred ratios will be different for either larger or smaller fasteners, or for fasteners of different materials. The inner diameter of washer 94 should be close to the diameter of the shaft 90 while still allowing assembly of the washer onto the shaft, and should preferably be about 0.005 inches (0.127 mm) larger than the shaft diameter. Manufacturing tolerances in forming the diameter of shaft 90 and the inner diameter of washer 94 may vary this relationship. The outer diameter of the rollover flare 92' should be sufficiently larger than the inner diameter of the washer 94 to maintain the washer on the rivet shaft 90, and should be sufficiently smaller than the outer diameter of the washer 94 to allow the washer 94 to flex or "dish" upon assembly to impart and maintain the desired compression on the fastened portions of strap 16. The ratio of the outer diameter of the rollover flare 92' to the inner diameter of washer 94 should preferably be between approximately 1.1:1 and 2:1, and more preferably should be approximately 1.3:1. The ratio of the outer diameter of the washer 94 to the outer diameter of rollover flare 92' should preferably be between approximately 1.1:1 and 5:1, and more preferably should be approximately 2:1. The outer diameter of washer 94 should also be sufficiently larger than the diameter of rivet shaft 90 to effectively compress a sufficient area of the fastened portions of strap 16. The ratio of the outer diameter of washer 94 to the diameter of shaft 90 should preferably be between approximately 1.1:1 and 5:1, and more preferably should be approximately 2.5:1. The outer diameter of the head 82 of rivet 81 should be approximately the same as the outer diameter of the washer 94 to effectively compress the fastened portions of strap 16. The ratio of the outer diameter of head 82 to washer 94 should preferably be from approximately 3:1 to 0.5:1, and more preferably should be approximately 1:1.

The fastener 80 is secured during assembly of flap 10 as follows. Shaft 90 is inserted through apertures 28 in the overlapping portions of strap 16. Washer 94 is placed over the fold down stem 92 of shaft 90, and the fold down stem is then flared sufficiently until the fastener 80 is reduced to a predetermined length. The predetermined length is that at which the fastener 80 imparts the desired compression to the fastened portions of strap 16. Optimum flap life is obtained when there is at least a minimum amount of compression in the fastened portions of the flap sufficient to prevent slipping of the fastened portions of strap 16 relative to one another and to the fastener 80 during use, and to prevent abraded debris from becoming lodged between the fastened portions of strap 16 and between the fastener 80 and the strap 16 during use. The initial compression must also be great enough to maintain compression over a period of extended use during which the fastened portions of strap 16 wear, stretch, compress, or otherwise become thinner. However, the initial compression should be below an acceptable maximum to reduce the likelihood that the fastener will dig into and tear or otherwise damage the strap 16. The amount of initial compression that the fastener 80 imparts on the fastened potions of the strap 16 is controlled by the final length of the fastener after fold down stem 92 is flared to form rollover flare 92'.

The process of determining the desired final length of the flared fastener is iterative, and involves checking the compression of the flaps by a suitable test at various post-flare lengths of the fastener until the desired strap compression is obtained at a particular flared length. Once the desired length of the flared fastener 80 is determined, that length setting is maintained on the flaring machine. Such assembly may be made by using a Chicago Riveter Model 190 flaring machine available from Chicago Rivet and Machine Company of Naperville, Ill.

One suitable test for determining whether the desired initial compression is obtained includes using two feeler gages. As the initial compression on the fastened strap portions is increased, the free edges of the strap portions at the sides of the peening flap 10 at "T" are displaced further from one another. If the smaller gage is not capable of being inserted to the desired depth, then the strap portions have not been sufficiently compressed and the fastener 80 must be flared to a shorter length to increase compression. If the smaller gage is capable of being inserted, then at least the minimum compression has been obtained. If the larger gage is capable of being inserted, then the strap portions are under too much compression, and the total length of the flared fastener 80 must be increased to reduce compression. If the larger gage cannot be inserted, then the maximum acceptable amount of compression has not been exceeded. In summary, the proper length of the rivet after flaring has been obtained, and therefore the desired amount of initial compression has been imparted to the fastened strap portions, when the smaller gage can be inserted to the desired depth and the larger gage cannot be inserted.

As to the feeler gages, it has been determined that a United States ten-cent coin (dime) is suitable for the smaller gage, and a United States five-cent coin (nickel) is suitable for the larger gage. The minimum preferred compression has been obtained when the dime can be inserted between the strap portions at T to at least a depth where the crown of the head on the obverse side of the dime is within the edge of the strap portions. The maximum preferred compression has been exceeded when the edge of a nickel can be inserted between the strap portions at T.

The flap constructions described above are ideally suited for use as the flaps in high-intensity roto peen devices such as the wheel shown and described in Minnesota Mining and Manufacturing Company product brochure 61-5000-5990-4 (1282)11, published December 1988, reproduced in part in FIG. 1. A plurality of peening flaps constructed as described above, typically 20 flaps for a fully loaded 4 inch (10.2 cm) diameter hub, are attached to a hub 100 at attachment locations 102. At attachment locations 102, the hub ends 12 of flaps 10 are inserted into a slot along with a keeper pin, the pin and flap material combining to form a tight fit in the slots. Assembly details of wheel constructions such as these (other than the flaps incorporating the novel fastener described herein) are known and need not be described in detail herein. Product assembly instructions number 34-7017-9636-8 published December 1988, from Minnesota Mining and Manufacturing Company, St. Paul, Minn., entitled "Heavy Duty Roto Peen Flap Wheel Assembly Instructions", describes in detail the assembly of such a wheel, and is incorporated herein by reference in its entirety. FIG. 1 shows that individual flaps 104 and 106 may be offset by 0.635 cm, for example, which is preferable, although not necessary, in such wheels to increase peening efficiency (i.e., decrease the time required to descale, finish, or stress relieve a surface). This offset may be obtained by using a spacer as described in U.S. Pat. No. 5,284,039, the contents of which are incorporated herein by reference.

The peening flap of the present invention is described further with reference to the following Examples.

EXAMPLE

Test Procedure: Peening flaps having conventional fasteners and peening flaps having fasteners according to the present invention were compared as follows. Three groups of flaps incorporating fasteners according to the present invention (types 1–3) were compared to two groups of peening flaps incorporating known fasteners (types 4–5). See Table 1. All of the peening flaps had 0.064 inch (1.63 mm) diameter peening particles. All five groups were mounted simultaneously on a 7 inch (178 mm) wide, 4 inch (102 mm) diameter hub driven by a Unique Systems Rotary Peening machine, model number 10714E (available from Unique Systems, Lansing, Ill. ). All of the fasteners in types 1–3 incorporated a fastener 80 according to the present invention, including a washer 94 fabricated from Nylon-6,6, available under the trade name Zytel 42 from E. I. dupont de Nemours of Wilmington, Del.

The above hub was used on an industrial floor to remove a 0.024 to 0.030 inch (0.61 to 0.76 mm) layer of epoxy coating. The epoxy coating was made up of 0.008 to 0.010 inches (0.20 to 0.25 mm) of CARBOLINE 300 epoxy surfacer (available from Carboline Company, St. Louis, Mo.), 0.010 to 0.012 inches (0.25 to 0.30 mm) of PHENOLINE 305 epoxy finish (also available from Carboline Company), and 0.006 to 0.008 inches (0.15 to 0.20 mm) of VALSPAR 76 epoxy finish (available from The Valspar Corporation, Minneapolis, Minn.). The epoxy coating was stripped from an 820 square feet (76 square meters) concrete floor of 5000 psi ($3.4\times10^4$ kPa) compressive strength to a surface profile suitable for a new coating application (based on Steel Structures Painting Council surface preparation requirements) in a period of 8 hours. No pre-chipping or other treatment was performed on the floor prior to rotary peening. The results of this test are presented in Table 1. Failure of the peening strap is defined as imminent separation of the strap from the fastener before the useful life of the peening support base and particles was reached. The superiority of the fastener of the present invention is readily apparent from the test results presented in Table 1.

TABLE 1

| Flap type | Peening support type | Flap width | Fastener shaft length | Number of flaps | Percent Strap Failure |
|---|---|---|---|---|---|
| 1 | D | 2.0" | .370" | 20 | 0% |
| 2 | D | 2.0" | .350" | 20 | 0% |
| 3 | A | 1.0" | .350" | 20 | 0% |
| 4 | D | 2.0" | .350" | 20 | 50% |
| 5 | A | 2.0" | .350" | 20 | 70% |

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. A peening flap, comprising:

a strap including a first strap portion, a second strap portion, a first aperture formed in said first portion and a second aperture formed in said second portion;

peening means mounted on said strap; and a fastener affixed to said strap for securing said first and second strap portions together, said fastener including:

a shaft extending through said apertures, said shaft having a first end and a second end; and a first head adjoining said first end and a second head adjoining said second end; wherein said first and second strap portions have a combined thickness and are secured between said first and second heads; and wherein said second head includes elastic compression means for maintaining compression on said strap portions, said elastic compression means having sufficient elasticity to maintain compression on said strap portions with reducing combined thickness.

2. A peening flap as in claim 1, wherein said elastic compression means includes an elastic washer.

3. A peening flap as in claim 2, wherein said elastic washer is a polymeric washer.

4. A peening flap as in claim 2, wherein said second end of said shaft includes a rollover flare for maintaining said elastic washer on said shaft.

5. A peening flap as in claim 4, wherein said rollover flare urges said washer against said first and second portions with sufficient force to compress said first and second portions.

6. A peening flap as in claim 5, wherein said rollover flare urges said washer against said first and second portions with sufficient pressure to elastically deform said washer.

7. A peening flap as in claim 6, wherein said elastic washer has sufficient elastic deformation to maintain compression on said strap portions with reducing combined thickness.

8. A peening flap as in claim 1, wherein said strap further includes a third portion, and wherein said fastener secures said first, second and third portions together under compression.

9. A peening flap as in claim 8, wherein said first strap portion is adjacent a first end of said strap, said second portion is adjacent a second end, and said third portion is between said first and second ends.

10. A peening flap as in claim 9, wherein said strap is folded such that said first head is adjacent said third strap portion, said second head is adjacent said second portion, and said first portion is between said second and third portions.

11. A peening flap as in claim 9, wherein said strap is folded such that said first head is adjacent said first strap portion, said second head is adjacent said third portion, and said second portion is between said first and third portions.

12. A peening flap as in claim 8, wherein said strap further includes a fourth portion, and wherein said fastener secures said first, second, third and fourth strap portions together under compression.

13. A peening flap as in claim 1, wherein said first head includes a bottom surface adjacent said strap and a side surface adjoining said bottom surface and extending around the periphery of said first head, wherein said bottom surface and said side surface intersect at an included angle of at least 90 degrees.

14. A peening flap as in claim 13, wherein said side surface is arcuate in the direction parallel to the longitudinal axis of said shaft.

15. A peening flap as in claim 1, wherein said fastener maintains said strap portions under sufficient compression to prevent abraded debris from becoming lodged between said fastener and said strap.

16. A peening flap as in claim 1, wherein said fastener maintains said strap portions under sufficient compression to prevent abraded debris from becoming lodged between said first and second strap portions.

17. A peening flap as in claim 1, wherein said fastener maintains said strap portions under sufficient compression to attenuate slipping between said fastener and said strap.

18. A peening flap as in claim 1, wherein said fastener maintains said strap portions under sufficient compression to attenuate slipping between said first and second strap portions.

19. A peening flap, comprising:

a strap including a first strap portion, a second strap portion, a first aperture formed in said first portion and a second aperture formed in said second portion;

peening means mounted on said strap; and a fastener four securing said first and second strap portions together under compression, said fastener including:

a shaft extending through said apertures, said shaft including a first end and a second end; and a first head adjoining said first end and a second head adjoining said second end;

wherein said first and second strap portions have a combined thickness and are secured between said first and second heads; and wherein said second head comprises an elastic washer and wherein said shaft further includes a rollover flare for urging said washer against said strap portions and for imparting sufficient elastic deformation into said elastic washer to maintain said strap portions under compression over reducing combined thickness of said strap portions.

20. A peening flap as in claim 19, wherein:

the ratio of the outer diameter of said washer to the outer diameter of said rollover flare is between 1.1:1 and 5:1;

the modulus of elasticity of said washer is between 10,000 and 600,000 psi;

the ratio of the outer diameter of said first head to the outer diameter of said washer is between 3:1 and 0.5:1; and the ratio of the outer diameter of said washer to the diameter of said shaft is between 1.1:1 and 5:1.

21. A peening flap as in claim 19, wherein:

the ratio of the outer diameter of said washer to the outer diameter of said rollover flare is approximately 2:1;

the modulus of elasticity of said washer is between 210,000 and 425,000 psi;

the ratio of the outer diameter of said first head to the outer diameter of said washer is approximately 1:1; and the ratio of the outer diameter of said washer to the diameter of said shaft is approximately 2.5:1.

22. A fastener for use in a peening flap of the type comprising a strap with a peening means affixed thereto and including at least first and second strap portions fastened together, said fastener comprising:

a shaft including a first end and a second end;

a first head adjacent said first end; and a second head adjacent said second end, wherein said first and second strap portions have a combined thickness and are secured between said first and second heads;

wherein said second head includes elastic compression means for maintaining compression on said strap portions, said elastic compression means having sufficient elasticity to maintain compression on said strap portions with reducing combined thickness.

23. A fastener as in claim 22, wherein said elastic compression means comprises an elastic washer.

24. A fastener as in claim 23, wherein said second end includes a rollover flare to urge said elastic washer against strap portions fastened between said first and second heads.

25. A fastener as in claim 24, wherein the ratio of the outer diameter of said elastic washer to the outer diameter of said rollover flare is between 1.1:1 and 5:1.

26. A fastener as in claim 24, wherein the ratio of the outer diameter of said elastic washer to the outer diameter of said rollover flare is approximately 2:1.

27. A fastener as in claim 23, wherein the modulus of elasticity of said elastic washer is between 10,000 and 600,000 psi.

28. A fastener as in claim 23, wherein the modulus of elasticity of said elastic washer is between 210,000 and 425,000 psi.

29. A fastener as in claim 23, where the ratio of the outer diameter of said first head to the outer diameter of said elastic washer is between 3:1 and 5:1.

30. A fastener as in claim 23, where the ratio of the outer diameter of said first head to the outer diameter of said elastic washer is approximately 1:1.

31. A fastener as in claim 23 , wherein the ratio of the outer diameter of said elastic washer to the diameter of said shaft is between 1.1:1 and 5:1.

32. A fastener as in claim 23, wherein the ratio of the outer diameter of said elastic washer to the diameter of said shaft is approximately 2.5:1.

33. A fastener as in claim 23, wherein said washer is a polymeric washer.

34. A fastener as in claim 22, wherein said first head includes a bottom surface perpendicular to the longitudinal axis of said shaft and facing said second head and a side surface adjoining said bottom surface and extending around the periphery of said first head, wherein said bottom surface and said side surface intersect at an included angle of at least 90 degrees.

35. A fastener as in claim 34, wherein said side surface is arcuate in the direction parallel to said shaft.

36. A fastener as in claim 22, wherein said elastic compression means maintains fastened strap portions under sufficient compression to prevent abraded debris from becoming lodged between said fastener and the strap.

37. A fastener as in claim 22, wherein said elastic compression means maintains the fastened strap portions under sufficient compression to prevent abraded debris from becoming lodged between the first and second strap portions.

38. A fastener as in claim 22, wherein said elastic compression means maintains the fastened strap portions under sufficient compression to attenuate slipping between said fastener and the strap.

39. A fastener as in claim 22, wherein said elastic compression means maintains the fastened strap portions under sufficient compression to attenuate slipping between the first and second strap portions.

40. A fastener for use in a peening flap of the type comprising a strap with a peening means affixed thereto and having at least a first and second strap portion fastened together, said fastener comprising:

a shaft including a first end and a second end;

a first head adjacent said first end; and a washer adjacent said second end;

wherein said second end further comprises a rollover flare to urge said washer against strap portions fastened between said first head and said washer;

wherein said washer is sufficiently elastic to maintain compression on strap portions fastened between said first and second heads over reducing combined thickness of the strap portions; and wherein:

the ratio of the outer diameter of said washer to the outer diameter of said rollover flare is between 1.1:1 and 5:1;

the modulus of elasticity of said washer is between 10,000 and 600,000 psi;

the ratio of the outer diameter of said first head to the outer diameter of said washer is between 3:1 and 0.5:1; and the ratio of the outer diameter of said washer to the diameter of said shaft is between 1.1:1 and 5:1.

41. The fastener of claim 40, wherein:

the ratio of the outer diameter of said washer to the outer diameter of said rollover flare is approximately 2:1;

the modulus of elasticity of said washer is between 210,000 and 425,000 psi;

the ratio of the outer diameter of said first head to the outer diameter of said washer is approximately 1:1; and the ratio of the outer diameter of said washer to the diameter of said shaft is approximately 2.5:1.

42. A rotary peening wheel comprising:

a hub; and at least one peening flap fastened to said hub;

wherein said peening flap includes:

a strap including a first strap portion, a second strap portion, a first aperture formed in said first portion and a second aperture formed in said second portion;

peening means mounted on said strap; and a fastener for securing said first and second strap portions together under compression, said fastener including:

a shaft extending through said apertures, said shaft including a first end and a second end; and a first head adjoining said first end and a second head adjoining said second end;

wherein said first and second strap portions have a combined thickness and are secured between said first and second heads; and wherein said second head includes elastic compression means for maintaining compression on said strap portions, said elastic compression means having sufficient elasticity to maintain compression on said strap portions with reducing combined thickness.

* * * * *

UNITED STATES PATENT AND TRADEMARK OFFICE

CERTIFICATE OF CORRECTION

PATENT NO.: 5,487,293

DATED: January 30, 1996

INVENTOR(S): Michael W. Lovejoy

It is certified that error appears in the above-identified patent and that said Letters Patent is hereby corrected as shown below:

Column 22, line 1, "four" should be -- for --.

Column 23, line 6, "5:1" should be -- .5:1 --.

Signed and Sealed this

Thirty-first Day of March, 1998

*Attest:*

*Attesting Officer*

BRUCE LEHMAN

*Commissioner of Patents and Trademarks*